US005556729A

United States Patent [19]

Fukuda et al.

[11] Patent Number: 5,556,729

[45] Date of Patent: Sep. 17, 1996

[54] NEGATIVELY CHARGEABLE ELECTROPHOTOGRAPHIC PHOTORECEPTOR

[75] Inventors: Yuzuru Fukuda; Tsuyoshi Ohta; Masato Ono; Taketoshi Higashi; Shigeru Yagi, all of Minami-ashigara, Japan

[73] Assignee: Fuji Xerox Co., Ltd., Tokyo, Japan

[21] Appl. No.: 464,466

[22] Filed: Jun. 5, 1995

Related U.S. Application Data

[63] Continuation of Ser. No. 197,746, Feb. 17, 1994, abandoned.

[30] Foreign Application Priority Data

Feb. 19, 1993 [JP] Japan ..... 5-053266

[51] Int. Cl.[6] ..... G03G 5/082

[52] U.S. Cl. ..... 430/65; 430/66; 430/67

[58] Field of Search ..... 430/65, 66, 67

[56] References Cited

U.S. PATENT DOCUMENTS

| | | | |
|---|---|---|---|
| 4,544,617 | 10/1985 | Mort et al. | 430/67 |
| 4,853,309 | 8/1989 | Hayakawa et al. | 430/67 |
| 4,923,773 | 5/1990 | Yagi et al. | 430/65 |
| 4,940,642 | 7/1990 | Shirai et al. | 430/65 |
| 4,960,662 | 10/1990 | Nishikawa et al. | 430/66 |
| 5,008,170 | 4/1991 | Karakida et al. | 430/65 |
| 5,059,501 | 10/1991 | Yagi et al. | 430/65 |

FOREIGN PATENT DOCUMENTS 60-112048 6/1985 Japan .

OTHER PUBLICATIONS

Diamond, Arthur S. (1991) Handbook of Imaging Materials. New York: Marcel–Dekker, Inc. pp. 447–455 & 482.

*Primary Examiner*—Christopher D. Rodee
*Attorney, Agent, or Firm*—Oliff & Berridge

[57] ABSTRACT

An electrophotographic photoreceptor comprising: an electrically conductive substrate, a charge injection blocking layer formed on said electrically conductive substrate, a photoconductive layer comprising a single layer formed on said charge injection blocking layer, said photoconductive layer comprising amorphous silicon containing boron, a positive hole capturing layer formed on said photoconductive layer, said positive hole capturing layer being selected from the group comprising amorphous silicon containing less than 50 ppm boron and amorphous silicon being substantially composed of hydrogen and silicon atoms, and a surface layer formed on said positive hole capturing layer. The boron concentration contained in said photoconductive layer is 0.01–1000 ppm. The surface layer is formed by amorphous silicon nitride, amorphous silicon oxide, amorphous silicon carbide or amorphous carbon as a main body. The charge injection blocking layer has amorphous silicon as a main body and contains a group V element. The electrophotographic photoreceptor is excellent in the dark attenuation, the sensitivity and electrification capacity and does not cause image flow or image fogging on copied images obtained by using the photoreceptor.

7 Claims, 1 Drawing Sheet

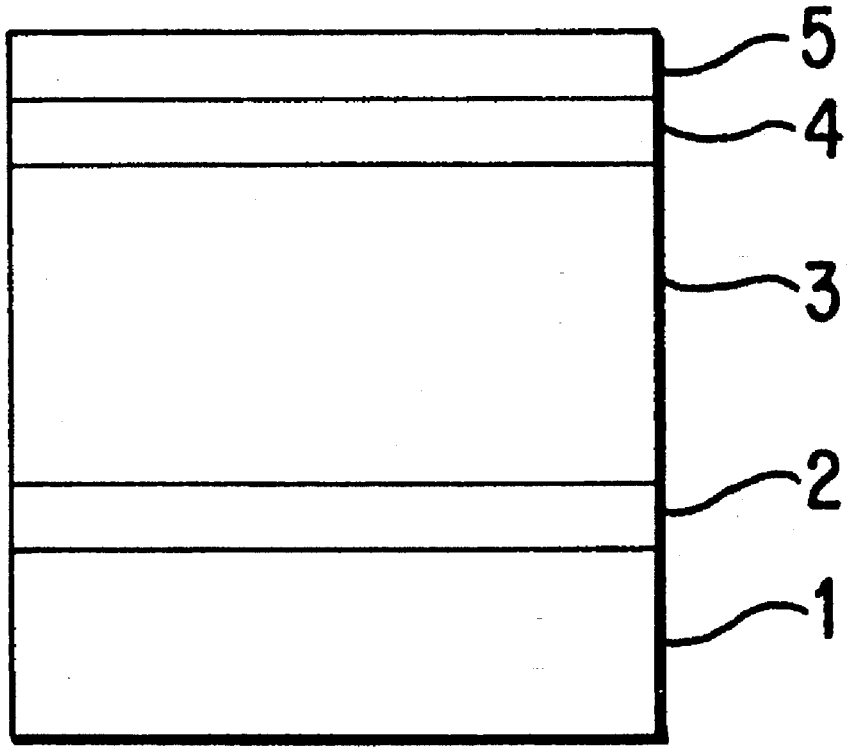
FIGURE

NEGATIVELY CHARGEABLE ELECTROPHOTOGRAPHIC PHOTORECEPTOR

This is a continuation of application Ser. No. 08/197,746 filed Feb. 17, 1994, now abandoned.

FIELD OF THE INVENTION

The present invention relates to an electrophotographic photoreceptor containing a positive hole capturing layer.

DESCRIPTION OF THE PRIOR ART

A variety of electrophotographic photoreceptor having an amorphous silicon photosensitive layer on a substrate have been proposed in recent years. These electrophotographic photoreceptors having an amorphous silicon photoconductive layer have characteristics excellent in the mechanical strength, panchromism, and photosensitivity at long wavelengths. However, in order to further improve the electrophotographic characteristics, a function-separation type of photoreceptor in which the photoconductive layer is seperated by their function into a charge generating layer and a charge transporting layer, or a photoreceptor having a surface layer and in which boron is contained in a photosensitive layer or the like has been proposed (for example, Japanese Patent Application (OPI) (the term "OPI" as used herein means an unexamined published patent application) No. Sho 60-112048).

In the electrophotographic photoreceptor having an amorphous silicon photosensitive layer provided with a surface layer proposed hitherto, depending on the boron concentration and the quality of the materials and the characteristics of the surface layer formed on it, light-generating charges may accumulate at the interface between the surface layer and the photoconductive layer, and lateral movement of the charges is caused at the interface, so that image flow may occur when boron is added into the amorphous silicon photosensitive layer. There occurs a problem that the electrophotographic photoreceptor can not be used satisfactorily.

The applicants of the present invention previously-suggested an electrophotographic photoreceptor which prevents the image flow (OPIs No. Hei 1-106071 and No. Hei 2-124578.

However, the electrophotographic photoreceptor disclosed in the above references is suitable when it is used as a photoreceptor for positive electrification. When it is used as a photoreceptor for negative electrification as it is, there occurs a problem that favorable properties can not be obtained in the respect of electrification capacity and image flow.

SUMMARY OF THE INVENTION

An object of the present invention is to provide an electrophotographic photoreceptor which is excellent in dark decay, sensitivity, and electrification.

Another object of the present invention is to provide an electrophotographic photoreceptor which does not cause image flow or image fogging on copied images obtained.

The present inventors have found that image flow can be prevented by forming a specific positive hole capturing layer between a photoconductive layer and a surface layer and thus have completed the present invention.

Thus the present invention provides an electrophotographic photoreceptor comprising: an electrically conductive substrate, a charge injection blocking layer formed on said electrically conductive substrate, a photoconductive layer comprising a single layer formed on said charge injection blocking layer, said photoconductive layer, comprising amorphous silicon containing boron, a positive hole capturing layer formed on said photoconductive layer, said positive hole capturing layer being selected from the group comprising amorphous silicon containing less than 50 ppm boron and amorphous silicon being substantially composed of hydrogen and silicon atoms, and a surface layer formed on said positive hole capturing layer.

BRIEF DESCRIPTION OF THE DRAWINGS

The FIGURE is a schematic sectional view showing the electrophotographic photoreceptor according to the present invention.

DESCRIPTION OF THE PREFERRED EMBODIMENT

The present invention will be detailed hereinafter with reference to the accompanying drawings.

The FIGURE is a schematic sectional view showing the electrophotographic photoreceptor according to the present invention.

With reference to the FIGURE, the numeral 1 shows a substrate, the numeral 2 shows a charge injection blocking layer, the numeral 3 shows a photoconductive layer, the numeral 4 shows a positive hole capturing layer and the numeral 5 shows a surface layer, which are formed in sequence.

In the electrophotographic photoreceptor of the present invention, either electrically conductive or insulating substrate may be used as the substrate. If the insulating substrate is used, at least one surface contacting with another layer must be treated to be made electrically conductive. The electrically conductive substrate may include metals such as stainless steel, aluminum and alloys or the like. The insulating substrate may include plastic films or sheets such as polyester, polyethlene, polycarbonate. polystyrene and polyamide, glass, ceramic and paper.

A charge injection blocking layer used for negative electrification is formed on the substrate. The charge injection blocking layer used for negative electrification is formed for the purpose of blocking the injection of positive holes from the substrate at the time of electrification. The charge injection blocking layer comprises amorphous silicon containing a group V element as a element controlling the conductivity as a main body. The group V element may include N, P, As, Sb, Bi in such case. Among them, the charge injection blocking layer has amorphous silicon nitride containing N as a group V element as a main body and that has amorphous silicon containing P are excellent in charge infection blocking ability and manufacturability, so that these are particularly preferable.

If the charge injection blocking layer comprising amorphous silicon nitride as a main body contains nitrogen in a concentration in the range of 0.01–0.7 in terms of the mole ratio to silicon, the high charge injection blocking ability is compatible with the low residual potential so that the layer has more excellent characteristics as a charge injection blocking layer. If the atom number ratio is less than 0.01, the charge injection blocking ability of positive hole at the time of negative electrification is reduced. If the atom number ratio exceeds 0.7, the residual potential of the electrophotographic photoreceptor is increased. The film thickness of the charge injection blocking layer is set in the range of 0.1–10 μm, preferably in the range of 0.1–5 μm.

The photoconductive layer is formed on the charge injection blocking layer. The photoconductive layer has amorphous silicon as a main body and contains boron. The boron concentration contained in the photoconductive layer is preferably in the range of 0.01–1000 ppm. Further, at least one of carbon, oxygen and nitrogen may be contained in the photoconductive layer in order to increase the electrification ability. The preferable boron concentration contained in the photoconductive layer is in the range of 0.01–20 ppm, particularly in the range of 0.01–5 ppm if carbon, oxygen and nitrogen are not contained in the photoconductive layer. It is in the range of 0.01–500 ppm if carbon, oxygen and nitrogen are contained in the photoconductive layer. If the boron concentration is less than 0.01 ppm, the effect of the addition of boron can not be taken. If the boron concentration exceeds 1000 ppm, there occurs a problem that the dark attenuation is increased, the electrification capacity is reduced and the sensitivity to light is reduced.

The boron concentration in the amorphous silicon film may be calculated by determining the amounts of silicon and boron using a secondary ionic mechanical spectrometer. In the cases, another quantitative determination method is preferably used at the same time. The methods used in combination with the method include a method quantitative determining the amorphous silicon film dissolved in an alkaline solution using IPC emission spectroscopic analysis (Induction bonding plasma emission spectroscopic analysis). The relation of the boron concentration in a gas phase and that in a film which were determined by the analysis is 2:1 and the relation did not change between 0.01 and 1000 ppm.

The elements such as germanium may be added into the photoconductive layer.

The film thickness of the photoconductive layer is set in the range 1–100 μm.

A positive hole capturing layer is formed between the photoconductive layer and the surface layer. The positive hole capturing layer comprises so called non-doped amorphous silicon as a main body which does not contain an element controlling the conductivity. Further, the positive hole capturing layer may comprise amorphous silicon containing 0–50 ppm boron as a main body. In such case, the boron concentration is set less than the boron concentration in the photoconductive layer.

If a positive hole capturing layer does not exist, positive holes of light generating charge are. accumulated at the interface between the photoconductive layer and the surface layer by the negative electrification, and lateral movement of the positive layer is caused at the interface by the electric field effect, and the phenomenon causing image flow occurs. However, if a positive hole capturing layer is formed, the layer acts to prevent the lateral movement of the positive holes by capturing the positive hole.

The film thickness of the positive hole capturing layer is set in the range of 0.01–5 μm.

A surface layer is formed on the positive hole capturing layer. The surface layer comprises at least one of the layers having amorphous silicon nitride, amorphous silicon oxide or amorphous carbon as a main body. A concentration gradient may be made in which the concentration of nitrogen, oxygen or carbon increases toward the surface in order to control the sensitivity, residual potential, resolution, charge maintenance at the time of electrification and mechanical strength. Further, a group III or V element may be added to the surface layer so as to control resistance.

The film thickness of the surface layer is set in the range of 0.1–10 μm, preferably in the range of 0.1–5 μm.

The electrophotographic photoreceptor of the present invention may be prepared by forming the charge injection blocking layer, the photoconductive layer, the positive capturing layer and the surface layer in sequence on the substrate. These layers may be formed by means of the glow discharge decomposition method, sputtering method, ion plating method, vacuum deposition method or the like. Although these methods for forming films may be selected depending on the purposes appropriately, the method of decomposing silane ($SiH_4$) gas or the like by glow discharge by a plasma CVD method may be preferably used.

With the plasma CVD method as an example, the method of forming films will be described hereinafter.

As the raw material gas for forming a layer having amorphous silicon as a main body, $Si_2H_6$, $Si_3H_3$, $Si_4H_{10}$, $SiCl_4$, $SiF_4$,$SiHF_3$, $SiH_2F_2$, $SiH_3F$ or the like, in addition to $SiH_4$ may be used. These raw material gases may be used in combination with a carrier gas such as a hydrogen, helium, argon, neon or the like.

In the formation of the photoconductive layer, diborane ($B_2H_5$) or the like is required to be incorporated in the raw material gases. The concentration of the diborane incorporated can be set appropriately so that the amorphous silicon photoconductive layer formed contains 0.01–1000 ppm boron adequately.

The photoconductive layer may further contain carbon, oxygen, nitrogen or the like. The raw material containing carbon to be used may include aliphatic hydrocarbons such as paraffin hydrocarbons represented by a general formula $CnH_2n_{+2}$ such as methane, ethane, propane, butane, pentane or the like, olefin hydrocarbons represented by a general formula $CnH_2n$ such as ethylene, propylene, butylene, pentene or the like, acetylene hydrocarbons represented by a general formula $CnH_2n_{-2}$ such as acetylene, arylene, butyne or the like; alicyclic hydrocarbons such as cyclopropane, cyclobutane, cyclopentane, cyclohexene or the like; aromatic hydrocarbon compounds such as benzene, toluene, xylene, naphthalene, anthracene or the like. Further the above hydrocarbon may be substituted by a halogen atom. For example, carbon tetrachloride, chloroform, carbon tetrafluoride, trifluoromethane, chlorofluoromethane, dichlorofluoromethane, bromotrifluoromethane, fluoroethane, perfluoropropane or the like may be used.

The raw material containing oxygen to be used may include a gas such as oxygen ($O_2$), ozone ($O_3$). carbon monooxide (CO), carbon dioxide ($CO_2$), nitrogen monooxide (NO), nitrogen dioxide ($NO_2$), dinitrogen trioxide trioxide ($N_2O_5$), dinitrogen tetraoxide ($N_2O_4$), nitrogen pentoxide ($N_2O_5$), nitrogen trioxide ($NO_3$), tetramethoxy silane ($Si(OCH_3)_4$), tetraethoxy silane ($Si(OC_2H_2)_4$) or the like.

The raw material containing nitrogen to be used may include gaseous or gasifiable compounds such as nitrogen gas ($N_2$), ammonia ($NH_3$), hydrazine ($NH_2NH_2$), hydrogen azide ($HN_3$), ammonium azide ($NH_4N_3$) or the like.

The raw material in order to add germanium may include $GeH_4$, $Ge_2H_6$, $Ge_3H_3$, $Ge_4H_{10}$, $Ge_5H_{12}$, $GeF_4$, $GeCl_4$ or the like.

A group V element is added to the charge injection blocking layer. A compound containing an element such as N, P, As, Sb, Bi or the like may be used as a raw material.

The examples of such raw materials may include nitrogen gas ($N_2$), ammonia ($NH_3$), hydrazine ($NH_2NH_2$), hydrogen azide ($HN_3$), phosphine ($PH_3$), $P_2H_4$, $PF_3$, $PCl_3$ or the like.

In the present invention, the formation of the positive hole capturing layer may be accomplished in the same manner as in the case of the formation of the photoconductive layer. If the positive capturing layer comprises so called non doped amorphous silicon as a main body, it may be formed entirely without using a gas containing an element such as boron or the like controlling the conductivity. If the layer comprises amorphous silicon containing less than 50 ppm boron as main body, diborane gas or the like may be used as in the case of formation of the photoconductive layer.

The surface layer comprises at least one of the layer having amorphous silicon nitride, amorphous silicon oxide, amorphous silicon carbide or amorphous carbon as a main body. When a layer having amorphous silicon nitride as a main body is formed, the above mentioned raw materials having nitrogen to be used may be used in combination with the above silicon compound gas such as silane or the like which is used in the layer having above amorphous silicon as a main body. When a layer having amorphous silicon oxide as a main body is formed, the above mentioned raw materials having oxygen to be used may be used in combination with the above silicon compound gas such as, the silane or the like. When a layer having amorphous silicon carbide as a main body is formed, the above mentioned raw materials having carbon to be used may be used in combination with the above silicon compound gas such as the silane or the like. When a layer having amorphous carbon as a main body is formed, the above mentioned raw materials having carbon to be used may be used.

If a group III or V element is added to the surface layer, for example, diborane, phosphine or the like may be used.

The film formation conditions of each layer are set in the range of frequency of 50 Hz–5 GHz, internal receptor pressure of $10^{-4}$ –5 Torr, discharge power of 10–2000 W, the substrate temperature of 30°–300° C. in the case of alternating current discharging. The film thickness of each layer can be set appropriately by adjusting the discharge time.

Embodiment

The present invention will be detailed by the following Examples and Comparative Examples.

EXAMPLE 1

Using a capacity-coupled type plasma CVD apparatus which can form film on a cylindrical substrate, the mixture of silane ($SiH_4$) gas, hydrogen gas and ammonia gas were decomposed by glow discharge to form a charge injection blocking layer comprising amorphous silicon nitride having a film thickness of about 0.5 μm on the cylindrical aluminum substrate. The film formation conditions for the above process were as follows:

Flow rate of 100% silane gas: 100 $cm^3$/min

Flow rate of 100% hydrogen gas: 150 $cm^3$/min

Flow rate of 100% ammonia gas: 50 $cm^3$/min

Internal pressure of reactor: 0.8 Torr

Discharge power: 200 W

Discharge frequency: 13.56 MHz

Substrate temperature: 250° C.

The nitrogen atom concentration in the charge injection blocking layer formed is 0.2 in terms of the atom number ratio to silicon.

After forming the charge injection blocking layer, the mixture of silane gas, diborane gas and hydrogen gas was introduced into the reactor to be decomposed by glow discharge, so that a photoconductive layer having a film thickness of about 20 μm was formed on the charge injection blocking layer. The film formation conditions for the above process were as follows:

Flow rate of 100% silane gas: 200 $cm^3$/min

Flow rate of diborane gas diluted with 10 ppm hydrogen: 4 $cm^3$/min

Flow rate of 100% hydrogen gas: 100 $cm^3$/min

Internal pressure of reactor: 0.8 Torr

Discharge power: 200 W

Discharge frequency: 13.56 MHz

Substrate temperature: 250° C.

The boron concentration in the photoconductive layer formed was 0.1 ppm.

After the formation of the photoconductive layer, the mixture of silane gas and hydrogen gas was introduced into the reactor to be decomposed by glow discharge, so that a positive layer capturing layer comprising non doped amorphous silicon having a film thickness of about 1 μm was formed on the photoconductive layer. The film formation conditions for the above process were as follows:

Flow rate of 100% silane gas: 200 $cm^3$/min

Flow rate of 100% hydrogen gas: 100 $cm^3$/min

Internal pressure of reactor: 0.8 Torr

Discharge power: 200 W

Discharge frequency: 13.56 MHz

Substrate temperature: 250° C.

After forming the positive hole capturing layer, the inside of the reactor was evacuated thoroughly, and by introducing the mixture of silane gas, hydrogen gas and ammonia gas and decomposing the mixture by glow discharge, a surface layer having a film thickness of about 0.3 μm was formed on the positive hole capturing layer. The film formation conditions for the process were as follows:

Flow rate of 100% silane gas: 25 $cm^3$/min

Flow rate of 100% hydrogen gas: 150 $cm^3$/min

Flow rate of 100% ammonia gas: 150 $cm^3$/min

Internal pressure of reactor: 0.8 Torr

Discharge power: 200 W

Discharge frequency: 13.56 MHz

Substrate temperature: 250° C.

The electrophotographic photoreceptor thus obtained was electrified at a surface potential –500 V at a temperature of 20° C. and a relative humidity of 15% and the sensitivity thereof was examined by image exposing. The sensitivity which is represented as the reciprocal of the light-exposure amount for half attenuation E50 was 3 erg/$cm^2$ for light of 650 nm and the residual potential was –50 V. In addition, the image obtained had an excellent resolution (7 1p/mm).

Comparative Example 1

By using the same apparatus, conditions and method as described in the Example 1 except that the positive hole capturing layer was not formed, a electrophotographic photoreceptor was formed. Accordingly, the electrophotographic photoreceptor had a charge injection blocking layer, a photoconductive layer and a surface layer on an aluminium substrate. The quality evaluation of the electrophotographic photoreceptor was carried out by using the same method and conditions as described in the Example 1. The image formed showed image fogging and the resolution was bad as 3 1p/mm.

EXAMPLE 2

Using a capacity-coupled type plasma CVD apparatus which can form a film on a cylindrical substrate, the mixture of silane ($SiH_4$) gas, hydrogen gas and phosphine ($PH_3$) gas were decomposed by glow discharge to form a charge injection blocking layer comprising amorphous silicon containing phosphorus having a film thickness of about 2 μm on the cylindrical aluminum substrate. The film formation conditions for the above process were as follows:

Flow rate of 100% silane gas: 200 $cm^3$/min

Flow rate of 100% hydrogen gas: 60 $cm^3$/min

Flow rate of 100% phosphine gas: 40 $cm^3$/min

Internal pressure of reactor: 0.8 Torr

Discharge power: 200 W

Discharge frequency: 13.56 MHz

Substrate temperature: 250° C.

After forming the charge injection blocking layer, the mixture of silane gas, diborane gas and hydrogen gas were introduced into the reactor to be decomposed by glow discharge, so that a photoconductive layer having a film thickness of about 20 μm was formed on the charge injection blocking layer. The film formation conditions for the above process were as follows:

Flow rate of 100% silane gas: 200 $cm^3$/min

Flow rate of diborane gas diluted with 10 ppm hydrogen: 8 $cm^3$/min

Flow rate of 100% hydrogen gas: 100 $cm^3$/min

Internal pressure of reactor: 0.8 Torr

Discharge power: 200 W

Discharge frequency: 13.56 MHz

Substrate temperature: 250° C.

The boron concentration in the photoconductive layer formed was 0.2 ppm.

After the formation of the photoconductive layer, the mixture of silane gas and hydrogen gas was introduced into the reactor to be decomposed by glow discharge, so that a positive hole capturing layer comprising non doped amorphous silicon having a film thickness of about 1 μm was formed on the photoconductive layer. The film formation conditions for the above process were as described in the Example 1.

After forming the positive hole capturing layer, an amorphous silicon nitride surface layer was formed under the same conditions as described in the Example 1.

The electrophotographic photoreceptor thus obtained was electrified at a surface potential-500 V at a temperature of 20° C. and a relative humidity of 15% and the sensitivity thereof was examined by image exposing. The sensitivity which is represented as the reciprocal of the light-exposure amount for half attenuation E50 was 2.8 erg/$cm^2$ for light of 650 nm and the residual potential was −15 V. In addition, the image obtained had an excellent resolution (7 1p/mm).

Comparative Example 2

By using the same apparatus, conditions and method as described in the Example 1 except that the positive hole capturing layer was not formed, an electrophotographic photoreceptor was formed. Accordingly, the electrophotographic photoreceptor had a charge injection blocking layer, a photoconductive layer and a surface layer on an aluminium substrate. The image quality evaluation of the electrophotographic photoreceptor was carried out by using the same method and conditions as described in the Example 1. The image formed showed image fogging and the resolution was bad as 2 1p/mm.

EXAMPLE 3

Using a capacity-coupled type plasma CVD apparatus which can form film on a cylindrical substrate, the mixture of silane ($SiH_4$) gas, hydrogen gas and ammonia gas were decomposed by glow discharge to form a charge injection blocking layer comprising amorphous silicon nitride having thickness of about 0.5 μm was formed on the cylindrical aluminum substrate. The film formation conditions for the above process were as follows:

Flow rate of 100% silane gas: 100 $cm^3$/min

Flow rate of 100% hydrogen gas: 150 $cm^3$/min

Flow rate of 100% ammonia gas: 50 $cm^3$/min

Internal pressure of reactor: 1.0 Torr

Discharge power: 250 W

Discharge frequency: 13.56 MHz

Substrate temperature: 250° C.

The nitrogen atom concentration in the charge injection blocking layer formed was 0.2 in terms of the atom number ratio to silicon.

After forming the charge injection blocking layer, the mixture of silane gas, diborane gas and hydrogen gas was introduced into the reactor to be decomposed by glow discharge, so that a photoconductive layer having a thickness of about 20 μm was formed on the charge injection blocking layer. The film formation conditions for the above process were as follows:

Flow rate of 100% silane gas: 200 cm

Flow rate of diborane gas diluted with 10 ppm hydrogen: 100 $cm^3$/min

Flow rate of 100% hydrogen gas: 100 $cm^3$/min

Internal pressure of reactor: 1.0 Torr

Discharge power: 250 W

Discharge frequency: 13.56 MHz

Substrate temperature: 250 W

The boron concentration in the photoconductive layer formed was 2.5 ppm.

After the formation of the photoconductive layer, the mixture of silane gas, diborane gas and hydrogen gas was introduced into the reactor to be decomposed by glow discharge, so that a positive hole capturing layer comprising boron doped amorphous silicon having a film thickness of about 1 μm was formed on the photoconductive layer. The boron concentration in the positive hole capturing layer formed was 0.05 ppm. The film formation conditions for the above process were as follows:

Flow rate of 100% silane gas: 200 $cm^3$/min

Flow rate of diborane gas diluted with 10 ppm hydrogen: 2 $cm^3$/min

Flow rate of 100% hydrogen gas: 100 $cm^3$/min

Internal pressure of reactor: 1.0 Torr

Discharge power: 250 W

Discharge frequency: 13.56 MHz

Substrate temperature: 250° C.

After forming the positive hole capturing layer, the inside of the reactor was evacuated thoroughly, and by introducing the mixture of silane gas, hydrogen gas and ammonia gas and decomposing the mixture by glow discharge, a surface layer having a film thickness of about 0.3 μm was formed on the positive hole capturing layer. The film formation conditions for the above process were as follows:

Flow rate of 100% silane gas: 25 $cm^3$/min

Flow rate of 100% hydrogen gas: 150 $cm^3$/min

Flow rate of 100% ammonia gas: 150 $cm^3$/min

Internal pressure of reactor: 1.0 Torr

Discharge power: 250 W

Discharge frequency: 13.56 MHz

Substrate temperature: 250° C.

The electrophotographic photoreceptor thus obtained was electrified at a surface potential-500 V at a temperature of 20° C. and a relative humidity of 15% and the sensitivity thereof was examined by image exposing. The sensitivity which is represented as the reciprocal of the light-exposure amount for half attenuation E50 was 3.2 erg/$cm^2$ for light of 650 nm and the residual potential was −53 V. In addition, the image obtained had an excellent resolution (7 1p/mm).

Comparative Example 3

By using the same apparatus, conditions and method as described in the Example 1 except that the positive hole capturing layer was not formed, an electrophotographic photoreceptor was formed. Accordingly, the electrophotographic photoreceptor had a charge injection blocking layer, a photoconductive layer and a surface layer on an aluminium substrate. The image quality evaluation of the electrophotographic photoreceptor was carried out by using the same method and conditions as described in the Example 1. The image formed showed image fogging and the resolution was bad as 3 1p/mm.

As described above, the electrophotographic photoreceptor of the present invention has the positive hole capturing layer interposed between the photoconductive layer and the surface layer which comprises amorphous silicon as a main body and contains less than 50 ppm boron or does not contain an element controlling the conductivity. Accordingly, the photoreceptor of the present invention has excellent properties in the respect of dark attenuation, the sensitivity and the electrification capacity as a photoreceptor used for negative electrification. Moreover, the copied images obtained do not cause image flow or image flogging.

While particular forms of the invention have been described, it will be apparent that various modification can be made without departing from the spirit and scope of the invention. Accordingly, it is not intended that the invention be limited except as by the appended claims.

We claim:

1. An electrophotographic photoreceptor comprising: (1) an electrically conductive substrate, (2) a charge injection blocking layer formed on said electrically conductive substrate, (3) a single-layer photoconductive layer formed on said charge injection blocking layer, said photoconductive layer consisting essentially of amorphous silicon containing 0.01 to 5 ppm boron, (4) a positive hole capturing layer formed on said photoconductive layer, said positive hole capturing layer consisting essentially of amorphous silicon and optionally boron, and (5) a surface layer formed on said positive hole capturing layer, wherein the boron concentration of said positive hole capturing layer is less than the boron concentration of said photoconductive layer and wherein said photoreceptor is negatively chargeable.

2. The electrophotographic photoreceptor of claim 1 wherein said surface layer comprises at least one of amorphous silicon nitride, amorphous silicon oxide, amorphous silicon carbide and amorphous carbon.

3. The electrophotographic photoreceptor of claim 1 wherein said charge injection blocking layer comprises amorphous silicon and a group V element as an element controlling conductivity.

4. The electrophotographic photoreceptor of claim 1 wherein said charge injection blocking layer comprises amorphous silicon nitride.

5. The electrophotographic photoreceptor of claim 4 wherein the nitrogen concentration in said charge injection blocking layer is in the range of 0.01 to 0.7 in terms of the mole ratio of nitrogen to silicon.

6. The electrophotographic photoreceptor of claim 1 wherein said charge injection blocking layer comprises amorphous silicon containing phosphorus.

7. A process for forming an image by negative electrification, comprising imagewise exposing an electrophotographic photoreceptor to light, said electrophotographic photoreceptor comprising: (1) an electrically conductive substrate, (2) a charge injection blocking layer formed on said electrically conductive substrate, (3) a single photoconductive layer formed on said charge injection blocking layer, said photoconductive layer consisting essentially of amorphous silicon containing 0.01 to 5 ppm boron, (4) a positive hole capturing layer formed on said photoconductive layer, said positive hole capturing layer consisting essentially of amorphous silicon and optionally boron and (5) a surface layer formed on said positive hole capturing layer, wherein the boron concentration of said positive hole capturing layer is less than the boron concentration of said photoconductive layer and wherein said photoreceptor is negatively chargeable.

* * * * *